United States Patent [19]

Hodgens, II

[11] Patent Number: 4,983,428

[45] Date of Patent: Jan. 8, 1991

[54] ETHYLENETHIOUREA WEAR RESISTANT ELECTROLESS NICKEL-BORON COATING COMPOSITIONS

[75] Inventor: Henry M. Hodgens, II, Jupiter, Fla.

[73] Assignee: United Technologies Corporation, Hartford, Conn.

[21] Appl. No.: 204,311

[22] Filed: Jun. 9, 1988

[51] Int. Cl.[5] ..... B05D 1/18

[52] U.S. Cl. ..... 427/443.1; 427/304; 427/305; 427/306; 427/438; 106/1.27

[58] Field of Search ..... 427/443.1, 304, 305, 427/306, 438; 106/1.27

[56] References Cited

U.S. PATENT DOCUMENTS

| | | | |
|---|---|---|---|
| 3,096,182 | 7/1963 | Berzins | 106/1 |
| 3,150,994 | 9/1964 | Hoke | 117/130 |
| 3,234,031 | 2/1986 | Zirngiebl et al. | 106/1 |
| 3,295,999 | 1/1967 | Klein et al. | 106/1 |
| 3,373,054 | 4/1968 | Lang et al. | 117/130 |
| 3,378,400 | 4/1968 | Sickles | 117/160 |
| 3,489,576 | 1/1970 | Vincent et al. | 106/1 |
| 3,565,667 | 2/1971 | Klingspor | 117/47 |
| 3,671,291 | 6/1972 | Miller et al. | 117/54 |
| 3,674,447 | 7/1972 | Hockessin | 29/196.6 |
| 3,723,158 | 3/1973 | Miller | 117/47 |
| 3,726,771 | 4/1973 | Coll-Palagos | 204/38 |
| 3,738,849 | 6/1973 | Bellis | 106/1 |
| 3,770,730 | 11/1973 | Brown | 260/240 |
| 3,782,978 | 1/1974 | Souza | 106/1 |
| 3,867,176 | 2/1975 | Dalton et al. | 117/50 |
| 3,943,168 | 3/1976 | Patterson | 252/519 |
| 3,962,495 | 6/1976 | Feldstein | 427/306 |
| 4,002,778 | 1/1977 | Bellis et al. | 427/98 |
| 4,016,447 | 4/1977 | Patterson | 313/218 |
| 4,019,910 | 4/1977 | Mallory | 106/1 |
| 4,152,164 | 5/1979 | Gulla et al. | 106/1.27 |
| 4,167,416 | 9/1979 | Zolla | 106/1.25 |
| 4,169,171 | 9/1979 | Narcus | 427/438 |
| 4,309,454 | 1/1982 | Feldstein | 427/97 |
| 4,328,266 | 5/1982 | Feldstein | 427/438 |
| 4,368,223 | 1/1983 | Kobayashi et al. | 427/443.1 |
| 4,407,869 | 10/1983 | Mallory et al. | 427/443.1 |
| 4,484,988 | 11/1984 | Robinson | 204/35.1 |

FOREIGN PATENT DOCUMENTS

| | | | |
|---|---|---|---|
| 785694 | 11/1957 | United Kingdom | 427/438 |

OTHER PUBLICATIONS

G. O. Mallory "The Electroless Nickel-Boron Plating Bath; Effects of Variables on Deposit Properties" Plating Apr. 1971 pp. 319-327.

*Primary Examiner*—Shrive Beck
*Assistant Examiner*—Vi Duong Dang
*Attorney, Agent, or Firm*—Fishman, Dionne & Cantor

[57] ABSTRACT

Electroless plating compositions are described which produce a boron containing nickel coating. The compositions comprise a water soluble nickel salt, a chelating agent, an alkali metal hydroxide, a boron containing reducing agent, and ethylenethiourea. The composition is particularly useful for providing such coatings on gas turbine engine parts and results in improved wear resistance.

14 Claims, No Drawings

ETHYLENETHIOUREA WEAR RESISTANT ELECTROLESS NICKEL-BORON COATING COMPOSITIONS

DESCRIPTION

1. Technical Field

The field of art to which this invention pertains is electroless plating compositions, and specifically nickel-boron plating compositions.

2. Background Art

Electroless nickel-boron plating compositions are known to supply hard, wear resistant coatings to various wear sensitive substrates. Because of recent environmental concerns the toxicity of electroless plating compositions has been looked at more closely. Current commercial processes use such materials as thallium to stabilize the plating compositions. However, thallium containing compositions do present some disposal problems because of their toxicity. On the other hand, the use of thallium in such plating compositions does provide good wear resistant properties.

There are compositions which are known which use thiourea in place of thallium. This does address some of the toxicity problems And while the thiourea containing compositions do provide coatings with properties comparable to the use of thallium containing compositions, there is a constant search in this art for compositions which will provide improved coatings, such as improved wear resistance.

DISCLOSURE OF INVENTION

An electroless nickel-boron coating composition is disclosed comprising an alkali metal hydroxide, a water soluble nickel salt, a chelating agent, a boron containing reducing agent and ethylenethiourea. The composition, in addition to being thallium free, results in improved luster, density, and wear resistance over other compositions.

Another aspect of the invention is a process for coating substrate materials with the above composition. A solution of the nickel salt, chelating agent and alkali metal hydroxide, are heated together to a temperature of 185° F. to 215° F. Following the heating step the ethylenethiourea and boron containing reducing components are added to initiate plating in the presence of the parts. The parts to be plated are then immersed in the solution. The concentrations of the nickel salt, boron containing reducing agent, ethylenethiourea, and alkali metal hydroxide (pH) are maintained over the entire plating period. Upon removal from the bath the parts have a nickel boron coating with improved wear resistance.

The foregoing and other features and advantages of the present invention will become more apparent from the following description.

BEST MODE FOR CARRYING OUT THE INVENTION

The alkali metal hydroxide preferred for use in the coating composition of the present invention is typically either sodium or potassium hydroxide. This material is used in amounts sufficient to produce a pH of about 12 to about 14, preferably about 13 to 14, and most preferably 13.7 to 14. The alkali metal hydroxide helps to maintain bath stability e.g. by keeping the borohydride stable and keeping the substrate material active (for plating and coating adherence) throughout the deposition process.

The nickel in the bath is provided through the use of a water soluble nickel salt. Nickel sulfamate is the preferred nickel salt. Other nickel compounds which may be used are nickel chloride, nickel sulfate, nickel ammonium sulfate, nickel acetate, nickel formate, and other water soluble nickel salts. Preferably the nickel component is present in an amount of about 0.09 mole per liter although concentrations of about 0.01 to 0.15 mole per liter can be used.

The amount of the nickel salt used in the bath is strongly dependent upon the concentration of chelating agent present in the bath. The preferred chelating agent is ethylenediamine. Other chelating agents which may be used are diethylenetriamine, triethylenetetraamine, ethylenediaminetetraacetate, diethylenetriaminepentaacetate. The amount of chelating agent used in the bath is determined by the amount of nickel present in the bath. Typically the molar concentration ratio of chelating agent to nickel is (in moles) 4/1 to 12/1, preferably 7/1 to 9/1, and most preferably 8/1 to 8.5/1 with 8.25/1 being the target. These ratios, and the concentrations of all of the active components can be monitored utilizing conventional chromatography and titrimetry techniques.

The boron containing reducing agent provides electrons to the catalytic surfaces to reduce the complexed nickel cations in the bath and also provides the boron content of the coating. The preferred boron compound is sodium borohydride and other boron compounds which may be used include potassium borohydride, tetralkyl ammonium borohydride, alkylamine boranes, and tetraphenyl phosphonium borohydride. The borohydride component is typically used in a concentration of about 0.002 mole to 0.052 mole per liter preferably 0.002 mole to 0.026 mole per liter, and most preferably at a concentration of about 0.010 mole per liter.

The ethylenethiourea component serves a bath stabilizing function. It is typically present in an amount of about 0.1 ppm (parts per million) to 10 ppm (0.098 to 9.8, X $10^{-5}$ mole per liter), preferably 0.5 ppm to 4 ppm (0.49 to 3.9, X $10^{-5}$ mole per liter), and most preferably 0.7 ppm to 2.5 ppm (0.6873 to 2,455, X $10^{-5}$ mole per liter).

The composition of the present invention is typically made by admixing the nickel salt, chelating agent and alkali metal hydroxide. The solution is then heated to a temperature of about 185° F. to 215° F. The ethylenethiourea and boron containing reducing agent are next added. The parts to be plated are then immersed in the plating solution and the concentrations of the components, pH and temperature maintained stable over the coating period. Functionally the temperature must not be so low that the nickel will not plate and not so high that the solution becomes unstable resulting in the precipitation of nickel boride particles. Typically temperatures of about 190° F. to 210° F. are usable, with 193° F. to 197° F. preferred and 195° F. to 196° F. most preferred.

The plating rate varies between 0.0001 and 0.0005 inch of thickness per hour depending on the maintenance of the concentration of components, especially the boron reducing agent, ethylenethiourea component and the temperature maintained. Typically what is aimed for is a coating of about 0.75 to about 1.5 mils thick coating of nickel boride. Flash coatings have been applied, and coatings as high as about 5 mils have also been produced. In fact, another advantage of the composition and process of the present invention is that low internal stresses are produced in the plate, allowing greater thicknesses to be deposited without exceeding the adhesive strength of the plate to the substrate. This allows plating to even greater plate thicknesses (for example, up to 50 mils). Coatings as low as about 0.1 mil are considered acceptable for some alloys (e.g. copper) alloys. The problem with thinner coatings is that during heat treatment, the boron tends to diffuse into the substrate which reduces the amount available for the nickel boride formation, which would result in less wear resistance.

If the concentration of the components remains constant, the thickness would be determined by the amount of time the substrate spends in the bath, also depending upon the temperature range maintained. And while any metal substrate can be coated with the process of the present invention, it is particularly well suited for titanium, steel, nickel, and copper (of course it is understood that while the substrate material is recited in terms of the metal material, this is meant to include the alloys of such metals as well). Other metals such as magnesium and aluminum can be coated if they are first subjected to a flash or strike coating (for example, zincate type immersion plate, followed by copper strike, and optionally a nickel strike coating) to protect the metal from attack at the high pH values used. The process is particularly well suited to substrate material which is prone to galling. The advantage to lighter weight metals such as titanium, aluminum and magnesium is that they can be provided with improved wear resistance by the process of the present invention. Gas turbine engine parts are particularly well suited for coating by the process of the present invention. It should be noted that the plating composition can also be applied to plastic substrate material (such as polyimides, acrylates, nylon, polyethylene, polypropylene, etc.). This would require a pre-treatment of the plastic substrate material with a sensitizing solution to make the plastic catalytic. By making the surface catalytic this allows electrons to be transferred from the reducing agent to the plastic surface and transferred again from the plastic surface to reduce the nickel. Treatment of the surface of the plastic substrate material with tin chloride solutions followed by subsequent treatment with solutions of palladium chloride are conventional sensitizing treatments in this art.

EXAMPLE 36 liters of high purity water was mixed with 2.8 liters of ethylenediamine. 1.74 kilograms of nickel sulfamate tetrahydrate and 2.6 kilograms of sodium hydroxide were added to this solution followed by the addition of sufficient water to yield 56 liters of solution (solution A). 0.1022 grams of ethylenethiourea were dissolved in sufficient water to yield 4 liters of solution (solution B). 800 grams of sodium hydroxide and 160 grams of sodium borohydride were dissolved in sufficient water to yield 4 liters of solution (solution C). 320 grams of nickel sulfamate, 300 milliters of ethylenediamine, and 10 grams of sodium hydroxide were dissolved in sufficient water to yield 2 liters of solution (solution D).

Solution A was prepared in a 15 gallon polypropylene and polytetrafluoroethylene plating rig fitted with a circulating pump and filter system. A polytetrafluoroethylene encapsulated immersion heater and temperature sensor was used to control the solution temperature at 195° F.±2° F. Solutions B, C and D were continually added from separate reservoirs by magnetically coupled, variable gear pumps based on analyses provided by ion and high performance liquid chromatography. The pH was maintained at 13.7 (or higher) by periodic additions of strong (5 molar) sodium hydroxide solution.

5 AMS 5508 (Greek ASCOLOY) panels measuring 80 square inches total and 3 Inconel 718 wear specimens measuring 14 square inches total were vapor blasted, activated in a 50 volume percent hydrochloric acid solution, flash nickel plated in a hydrochloric acid nickel chloride solution, rinsed, and transferred to the nickel-boron plating solution. During the course of plating, the solution chemistry was maintained as follows: nickel cation ($Ni^{+2}$) 5600 ppm to 6400 ppm (0.095 to 0.109 mole per liter nickel sulfamate tetrahydrate); ethylenediamine, 47000 to 53000 ppm (0.782 to 0.883 mole per liter); borohydride anion ($BH_4^{-1}$) 125 to 177 ppm (8.46 to 11.90, X $10^{-3}$ mole per liter sodium borohydride); ethylenethiourea, 1.1 to 1.6 ppm (1.08 to 1.57, X $10^{-5}$ mole per liter).

Plating of the specimens was maintained over a 9 hour period after which the parts were rinsed, dried and heat treated for 90 minutes at 675° F. The resulting nickel-boron plating measured 0.002 inch in thickness with a minimum hardness of 1000 HV (Hardness, Vickers). As plated, the coating consists of an amorphous layer of nickel and boron. Subsequent heat treatment yields a fine dispersion of nickel boride particles in a nickel matrix resulting in improved wear resistance over the coating if it is not heat treated.

The plating bath is ideally operated utilizing an automated analysis/solution replenishment system. Such a system would incorporate a computer controlled solution replenishment feedback system with the high performance liquid and ion chromatography.

In addition to the improved luster resulting from the present process, higher density and improved wear resistance are also produced in the coated articles according to the present invention. It is also significant to note that the composition is thallium free. The elimination of the thallium in the solution produces a significant reduction in toxicity hazard for the platers. It should also be noted that being thallium free the plating solution is easier to handle in terms of hazardous waste and disposal.

Although this invention has been shown and described with respect to detailed embodiments thereof, it will be understood by those skilled in the art that various changes in form and detail thereof may be made without departing from the spirit and scope of the claimed invention.

What is claimed is:

1. An electroless nickel-boron plating composition consisting essentially of a water soluble nickel salt, a chelating agent, alkali metal hydroxide, a boron containing reducing agent and 0.098 X $10^{-5}$ mole per liter to 9.8 X $10^{-5}$ mole per liter of ethylenethiourea.

2. The composition of claim 1 wherein the alkali metal hydroxide is sodium or potassium hydroxide present in an amount sufficient to produce a pH of about 12 to 14.

3. The composition of claim 1 wherein the water soluble nickel salt is nickel sulfamate present in an amount of about 0.01 mole per liter to 0.15 mole per liter.

4. The composition of claim 1 wherein the chelating agent is ethylenediamine and the molar concentration ratio of chelating agent to nickel salt is 4/1 to 12/1.

5. The composition of claim 1 wherein the ethylenethiourea is present in an amount of $0.49 \times 10^{-5}$ to $3.9 \times 10^{-5}$ mole per liter.

6. The composition of claim 1 wherein the boron containing reducing agent is sodium borohydride present in an amount of about 0.002 mole per liter to 0.052 mole per liter.

7. A process of electroless plating a nickel-boron coating onto a substrate material comprising admixing a composition consisting essentially of a water soluble nickel salt, a chelating agent, an alkali metal hydroxide, a boron containing reducing agent and $0.098 \times 10^{-5}$ mole per liter to $9.8 \times 10^{-5}$ mole per liter of ethylenethiourea, heating the solution to a temperature of 185° F. to 215° F., immersing the substrate in the solution, and removing the coated substrate from the solution, resulting in a nickel boron coated substrate having improved wear resistance.

8. The process of claim 7 including maintaining concentrations of the solution components and the solution temperature constant throughout the plating process.

9. The process of claim 7 wherein the alkali metal hydroxide is sodium or potassium hydroxide present in an amount sufficient to produce a pH of about 12 to 14.

10. The process of claim 7 wherein the water soluble nickel salt is nickel sulfamate present in an amount of about 0.01 mole per liter to 0.15 mole per liter.

11. The process of claim 7 wherein the chelating agent is ethylenediamine and the molar concentration ratio of chelating agent to nickel salt is 4/1 to 12/1.

12. The process of claim 7 wherein the ethylenethiourea is present in an amount of $0.49 \times 10^{-5}$ to $3.9 \times 10^{-5}$ mole per liter.

13. The process of claim 7 wherein the substrate comprises titanium, steel, nickel, copper, aluminum or magnesium.

14. The process of claim 7 wherein the coating is at least 0.1 mil thick.

* * * * *